US009763520B1

(12) United States Patent
Pan

(10) Patent No.: US 9,763,520 B1
(45) Date of Patent: Sep. 19, 2017

(54) RECLINABLE OFFICE CHAIR

(71) Applicant: Oasyschair Co., Ltd, Tainan (TW)

(72) Inventor: Toung-Chun Pan, Tainan (TW)

(73) Assignee: Oasychair Co., Ltd, Tainan (TW)

( * ) Notice: Subject to any disclaimer, the term of this patent is extended or adjusted under 35 U.S.C. 154(b) by 0 days.

(21) Appl. No.: 15/236,562

(22) Filed: Aug. 15, 2016

(51) Int. Cl.
*A47C 1/032* (2006.01)

(52) U.S. Cl.
CPC ..... *A47C 1/03255* (2013.01)

(58) Field of Classification Search
CPC ..... A47C 1/03255; A47C 3/02
USPC ..... 297/258.1, 270.1, 314, 313, 325
See application file for complete search history.

(56) References Cited

U.S. PATENT DOCUMENTS 4,099,697 A * 7/1978 Von Schuckmann .. A47C 3/026 248/398
5,044,587 A * 9/1991 Degen ..... A47C 3/025 108/150
5,524,967 A * 6/1996 Glockl ..... A47C 9/002 248/372.1
2015/0272331 A1* 10/2015 Glockl ..... A47C 3/026 297/258.1

* cited by examiner

*Primary Examiner* — Milton Nelson, Jr.
(74) *Attorney, Agent, or Firm* — Alan D. Kamrath; Kamrath IP Lawfirm, P.A.

(57) ABSTRACT

A reclinable office chair includes a reclination adjustment unit disposed at the bottom of the office chair. The reclination adjustment unit balances itself on the floor properly, resiliently and steadily. The office chair tilted in a forward-backward direction and/or a left-right direction displays directional stability relative to the floor in a manner not to lose the directional stability even when a sitter tilts in any direction, thereby allowing the office chair to provide a comfortable seat for the sitter to sit on, regardless of whether the office chair is upright or tilted in any direction.

6 Claims, 11 Drawing Sheets

RECLINABLE OFFICE CHAIR

BACKGROUND OF THE INVENTION

Field of the Invention

The present invention relates to reclinable office chairs and, more particularly, to a reclinable office chair provided in the form of a tall office chair whose bottom is coupled to a reclination adjustment unit, whereby the tall office chair is precisely, steadily underpinned by the floor to provide a comfortable seat for a user to sit on whenever the tall office chair is tilted in a forward-backward direction and/or a left-right direction.

Description of the Prior Art

To take a rest while at work, persons whose work require them to stand for a long period of time, such as sale assistants and hairdressers, usually sit on a tall office chair 40 (shown in FIG. 9) while standing on their feet. The office chair 40 comprises a support portion 10, a bottom base 20 coupled to the lower end of the support portion 10, and a seat portion 30 disposed on the upper end of the support portion 10, as well has its height adjustable timely. Although a person can relax their legs by sitting on the office chair 40 while at work, the person sometimes has to lean forward in order to work and thus inevitably tilts the office chair 40. However, only a portion of the rim of the bottom base 20 of the office chair 40 thus tilted rests on the floor. As a result, the office chair 40 thus tilted is so unstable that the sitter has to exert a force for balancing the office chair 40 at the expense of the user's relaxation.

SUMMARY OF THE INVENTION

The present invention aims to solve the problem with a conventional tall office chair's failure to be steadily supported when tilted forward and, thus, its failure to enable the sitter to relax their legs fully. To this end, the present invention provides a reclinable office chair, characterized in that a reclination adjustment unit is disposed at the bottom of the office chair. The reclination adjustment unit balances itself on the floor properly, resiliently and steadily. The office chair tilted in a forward-backward direction and/or a left-right direction displays directional stability relative to the floor in a manner not to lose the directional stability even when a sitter tilts in any direction, thereby allowing the office chair to provide a comfortable seat for the sitter to sit on, regardless of whether the office chair is upright or tilted in any direction.

The first objective of the present invention is to provide a reclinable office chair, steadily underpinned by the floor while being tilted in a forward-backward direction or a left-right direction, characterized in that: an annular receiving region is concavely defined in a predetermined space on an upward side of the bottom base of the office chair such that a reclination adjustment unit can be disposed at a bottom of the office chair. The reclination adjustment unit comprises a bottom base, a connecting element, carrying elements, and a concealing element. Limiting segments extend outward from the carrying elements and are confined to between the bottom base and the connecting element, such that the connecting element and the bottom base are separated by an appropriately flexible distance. Hook portions and block portions extend downward from the concealing element to a predetermined extent to clamp the connecting element from above and below. A through hole is centrally disposed at the concealing element and penetrable by an upright support portion of the office chair and a sleeve segment coupled to a lower segment of the support portion, such that the support portion and the sleeve segment are inserted into and thus properly, tightly connected to an opening centrally disposed at the connecting element. The reclination adjustment unit balances itself on the floor properly, resiliently and steadily. The office chair tilted in a forward-backward direction or a left-right direction displays directional stability relative to the floor in a manner not to lose the directional stability even when a sitter tilts in any direction, thereby allowing the office chair to provide a comfortable seat for the sitter to sit on, regardless of whether the office chair is upright or tilted in any direction.

The second objective of the present invention is to provide the reclination adjustment unit characterized in that: the limiting segments, which extend outward from the carrying elements and are confined to between the bottom base and the connecting element, are each provided in the form of a threaded bolt segment for penetrating apertures of the bottom base below and apertures of the connecting element above and undergo directional engagement with washers and screwing components, such that each carrying element gives an appropriate resilient support effectuated and maintained between the connecting element and the bottom base.

The third objective of the present invention is to provide the reclination adjustment unit characterized in that: the hook portions and the block portions, which extend downward from the concealing element to properly clamp the connecting element from above and below, interlace with each other, thereby imposing a balanced directional limitation upon the connecting element from above and below.

The fourth objective of the present invention is to provide the reclination adjustment unit characterized in that: each carrying element confined to between the bottom base and the connecting element, is centrally constricted and has its upper and lower ends slightly protruded, such that the reclination adjustment unit not only maintains appropriate, resilient deformation but is also subjected to no excessive hindrance whenever the office chair is tilted in any direction.

The fifth objective of the present invention is to provide the reclination adjustment unit characterized in that: the limiting segments, which extend outward from the carrying elements and are confined to between the bottom base and the connecting element, are integrally with and thus implanted in predetermined portions of the carrying elements, respectively.

The sixth objective of the present invention is to provide the reclination adjustment unit which comprises recesses and ribs, with the recesses concavely formed low at the bottom base, the ribs disposed at the bottom base and separated by a predetermined distance to form joint pipe segments, allowing an end of a non-slip pad to be tightly admitted into a corresponding one of the joint pipe segments.

BRIEF DESCRIPTION OF THE DRAWINGS

FIG. 5-1 is an enlarged view of the reclination adjustment unit with reference to FIG. 5;

FIG. 6-1 is an enlarged view of the reclination adjustment unit tilted and sunk with reference to FIG. 6;

DETAILED DESCRIPTION OF THE EMBODIMENTS OF THE INVENTION

Figure 1:
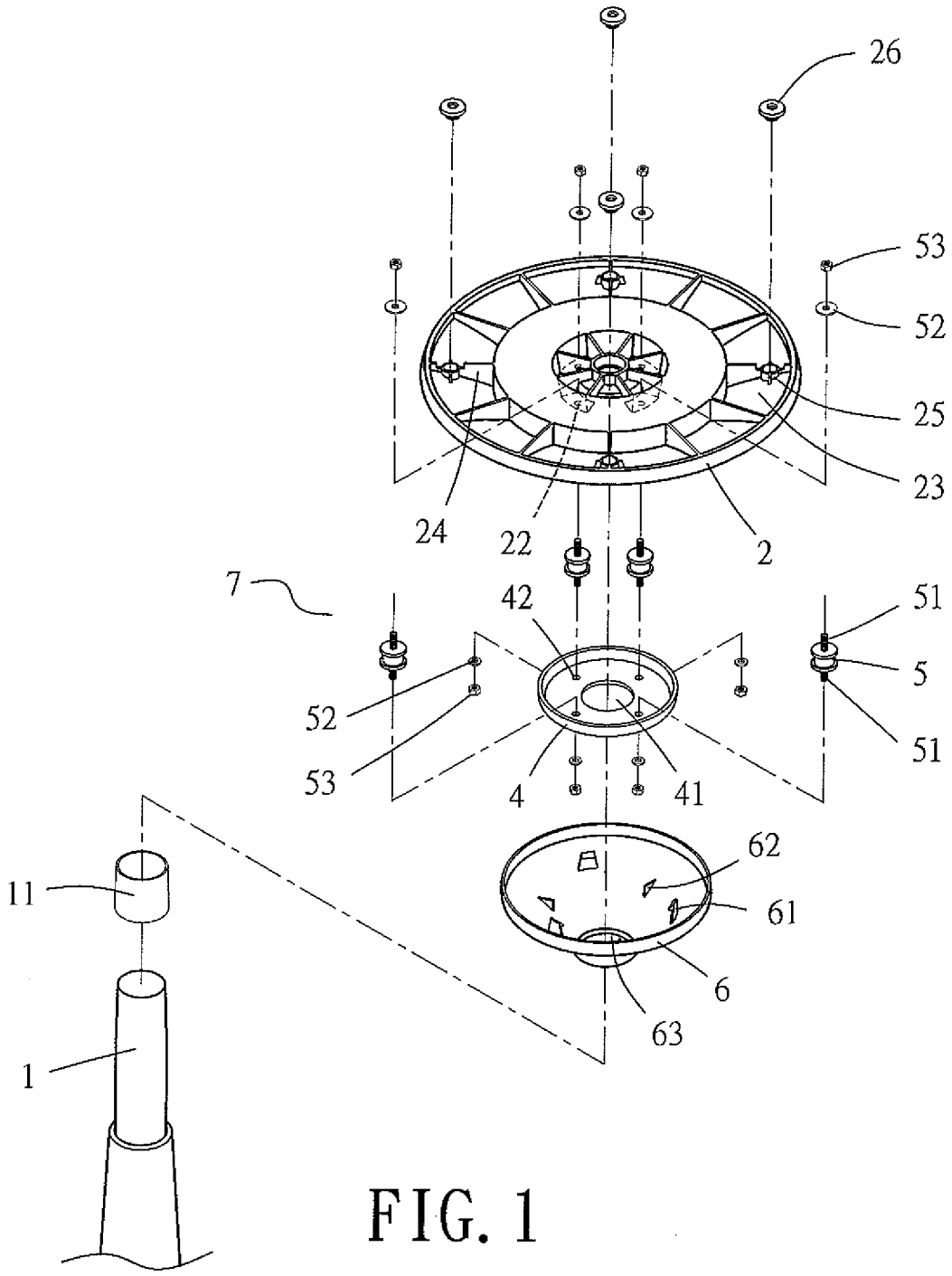
FIG. 1 is an exploded view of a bottom base and related components of an office chair viewed from below according to the present invention.
Figure 3:
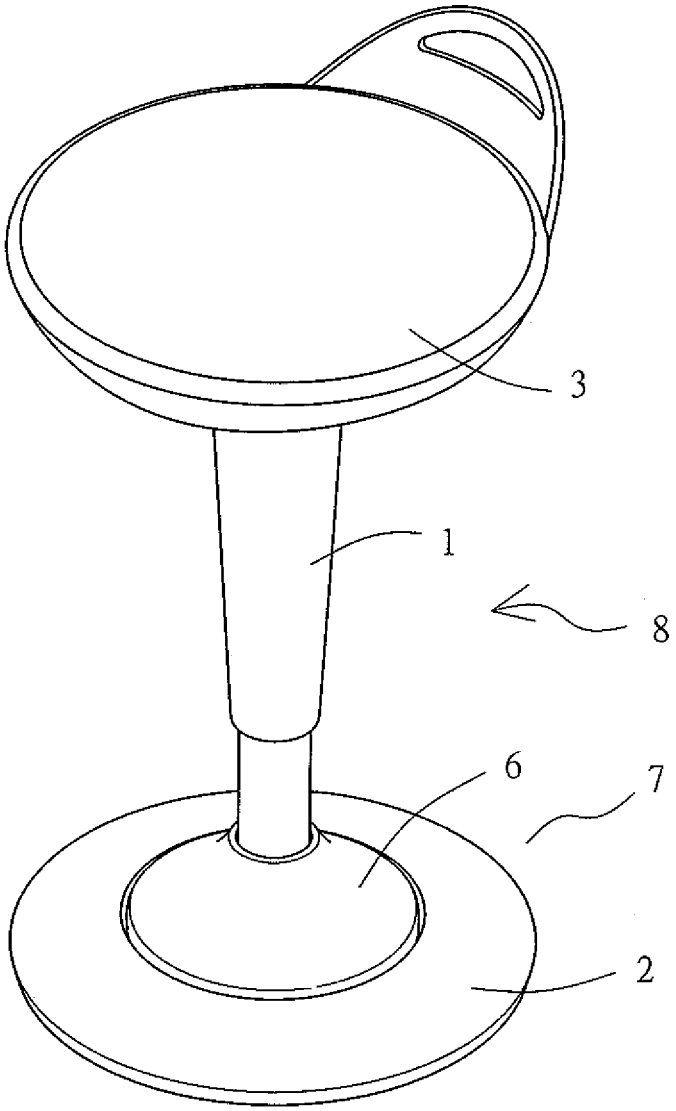
FIG. 3 is a perspective view which shows the bottom of the office chair coupled to a reclination adjustment unit according to the present invention.
Figure 4:
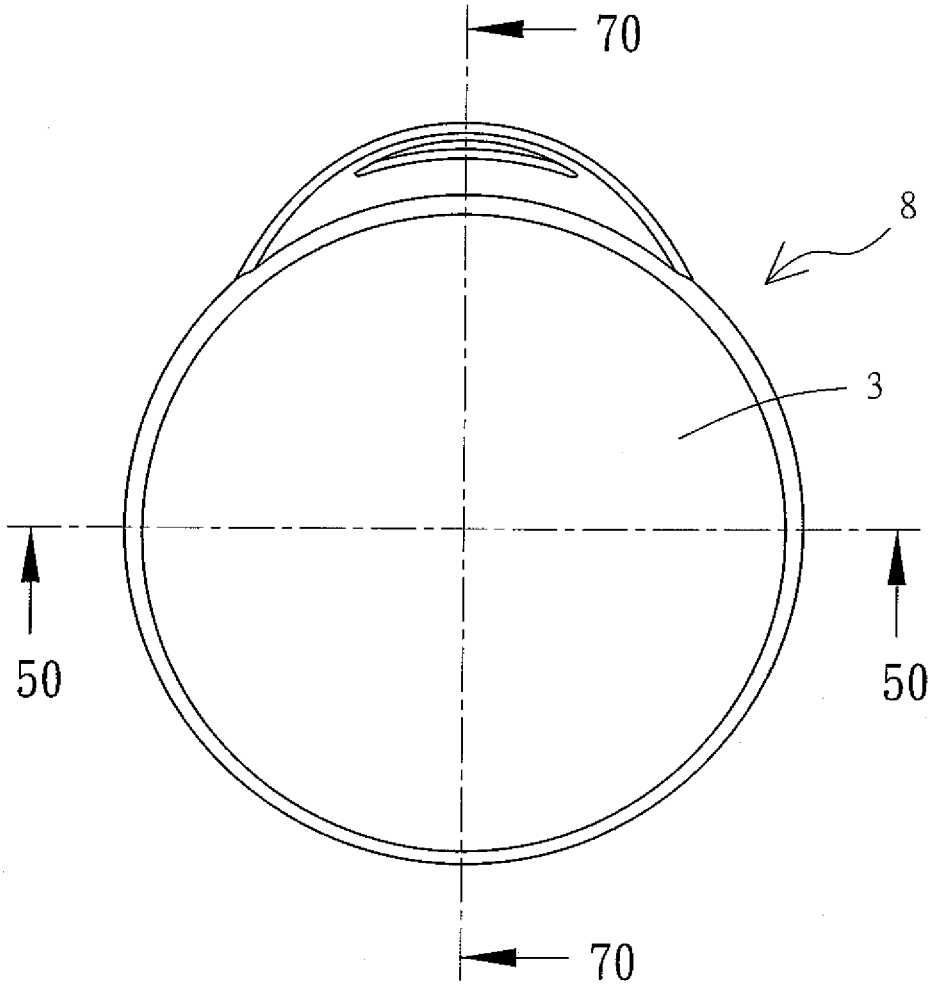
FIG. 4 is a top view which shows the bottom of the office chair coupled to the reclination adjustment unit according to the present invention.

Referring to FIG. 3, a reclinable office chair is provided by the present invention and in the form of a tall office chair 8 which comprises a support portion 1, a bottom base 2 coupled to the lower end of the support portion 1, and a seat portion 3 disposed on the upper end of the support portion 1. The arrangement of the aforesaid components is not claimed by the present invention. To allow the office chair 8 in operation to be steadily underpinned by the floor while being tilted in a forward-backward direction and/or a left-right direction (as shown in FIG. 1), the reclinable office chair of the present invention is characterized in that: an annular receiving region 21 (shown in FIG. 5) is concavely defined in a predetermined space on the upward side of the bottom base 2 of the office chair 8 such that a reclination adjustment unit 7 is disposed at the bottom of the office chair 8. The reclination adjustment unit 7 comprises a bottom base 2, a connecting element 4, carrying elements 5, and a concealing element 6.

Figure 5:
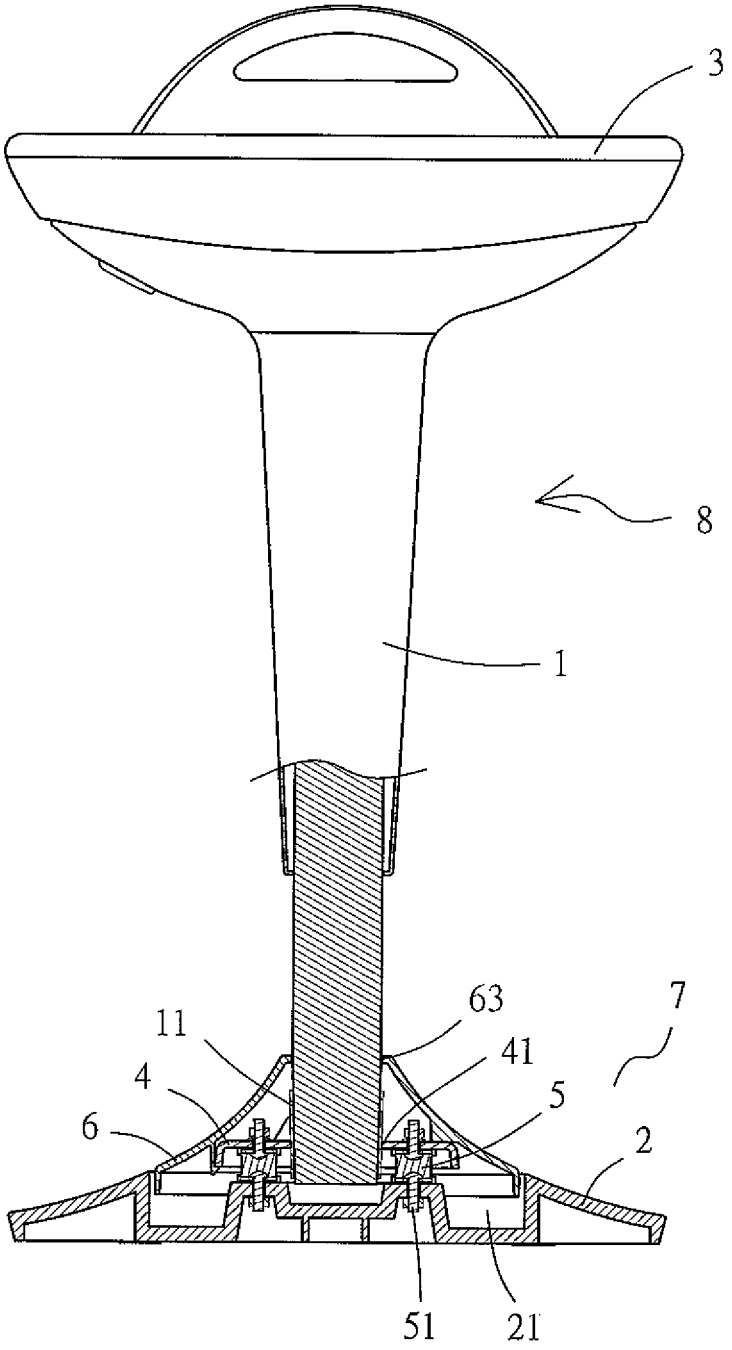
FIG. 5 is a cross-sectional view taken along line 50-50 of FIG. 4.
Figures 1, 5:
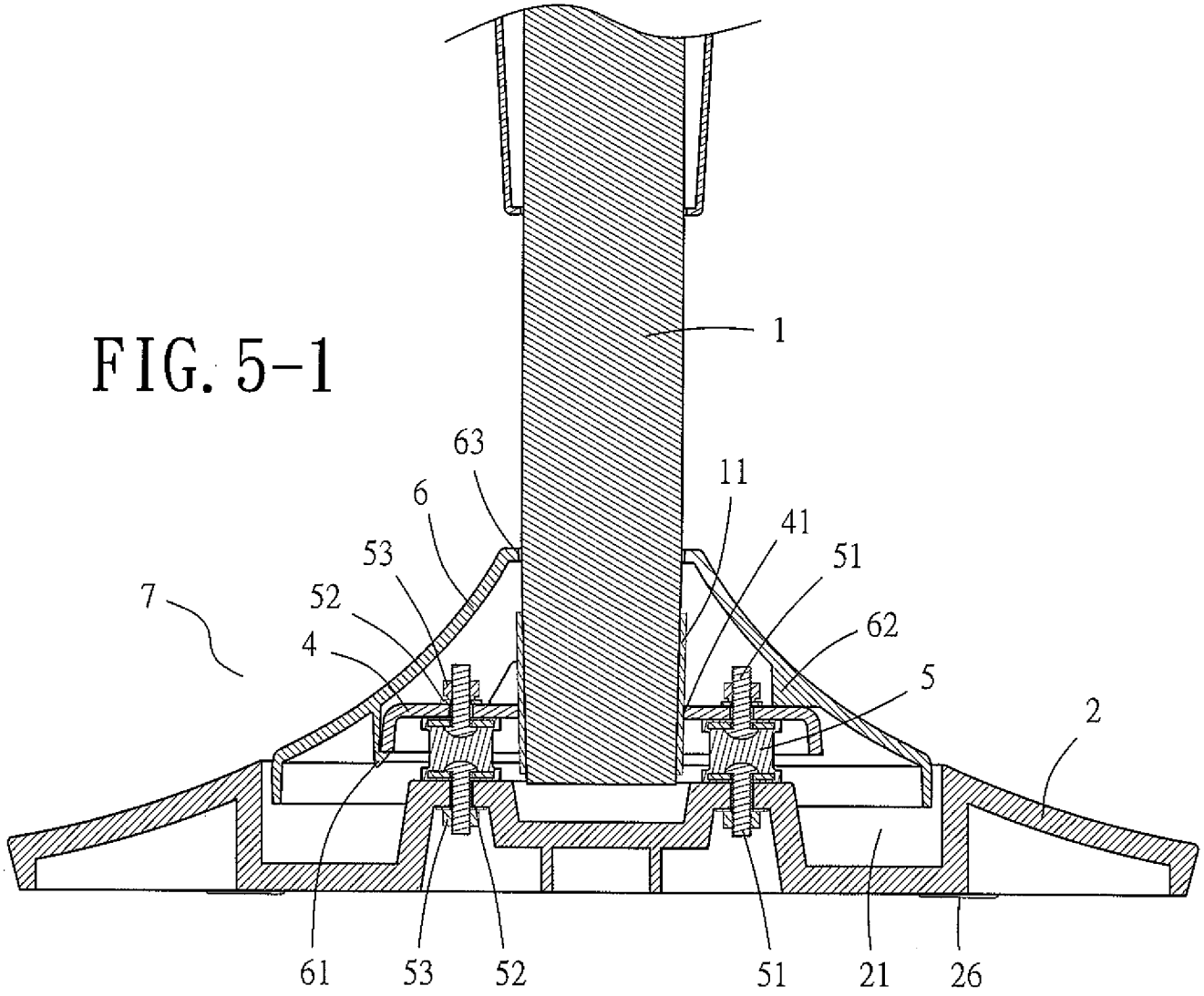

Limiting segments 51 extend outward from the carrying elements 5 and are confined to between the bottom base 2 and the connecting element 4, such that the connecting element 4 and the bottom base 2 are separated by an appropriately flexible distance (shown in FIG. 5-1). Hook portions 61 and block portions 62 extend downward from the concealing element 6 to a predetermined extent to clamp the connecting element 4 from above and below (as shown in FIG. 1, FIG. 5-1). A through hole 63 is centrally disposed at the concealing element 6 and penetrable by the support portion 1 and a high-toughness sleeve segment 11 coupled to the lower segment of the support portion 1. Hence, the support portion 1 and the sleeve segment 11 are inserted into and thus properly, tightly connected to an opening 41 centrally disposed at the connecting element 4.

The limiting segments 51, which extend outward from the carrying elements 5 and are confined to between the bottom base 2 and the connecting element 4, are each provided in the form of a threaded bolt segment to bring the advantage as follows: threaded bolt segments penetrate apertures 22 of the bottom base 2 below and apertures 42 of the connecting element 4 above and undergo directional engagement with washers 52 and screwing components 53 (as shown in FIG. 1 and FIG. 5-1), such that each carrying element 5 gives an appropriate resilient support effectuated and maintained between the connecting element 4 and the bottom base 2. The hook portions 61 and the block portions 62, which extend downward from the concealing element 6 to properly clamp the connecting element 4 from above and below, interlace with each other, thereby imposing a balanced directional limitation upon the connecting element 4 from above and below, as well as laterally.

Figure 2:
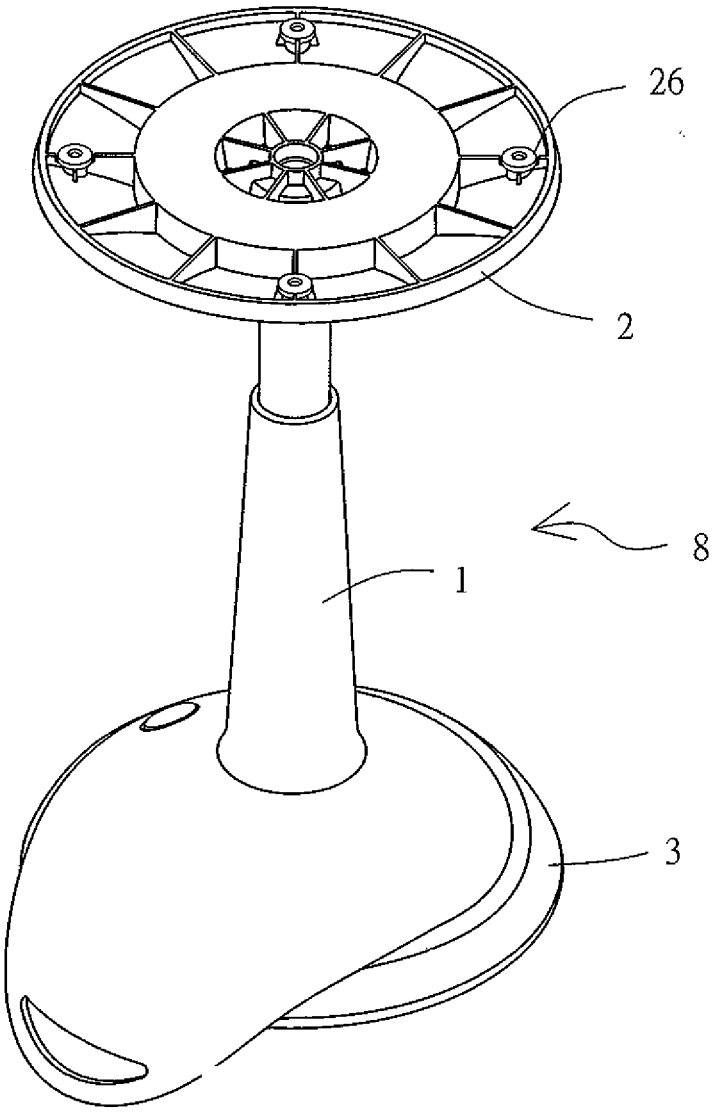
FIG. 2 is a perspective view of the bottom base and related components of the office chair when assembled and viewed from below according to the present invention.
Figure 6:
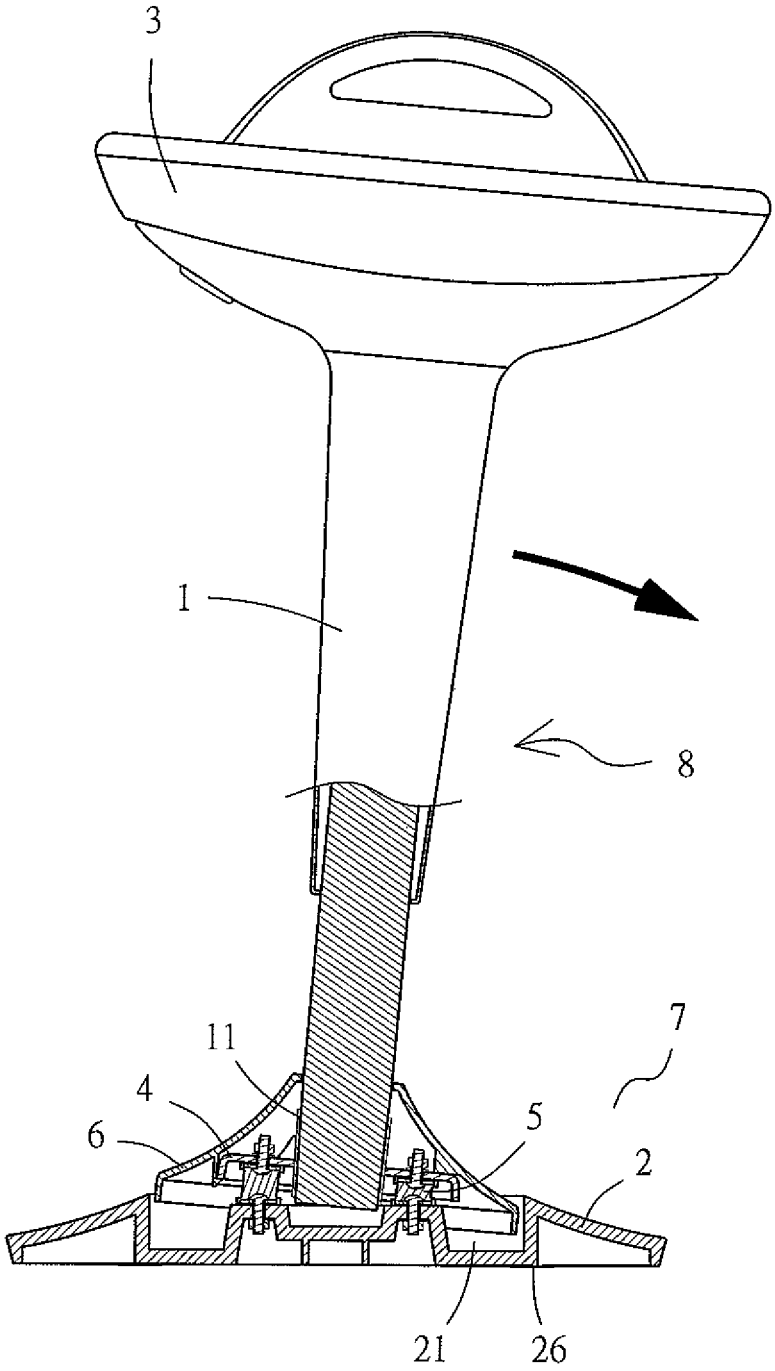
FIG. 6 is a cross-sectional view which shows the lateral tilt of the office chair whose bottom is coupled to the reclination adjustment unit according to the present invention.
Figures 1, 6:
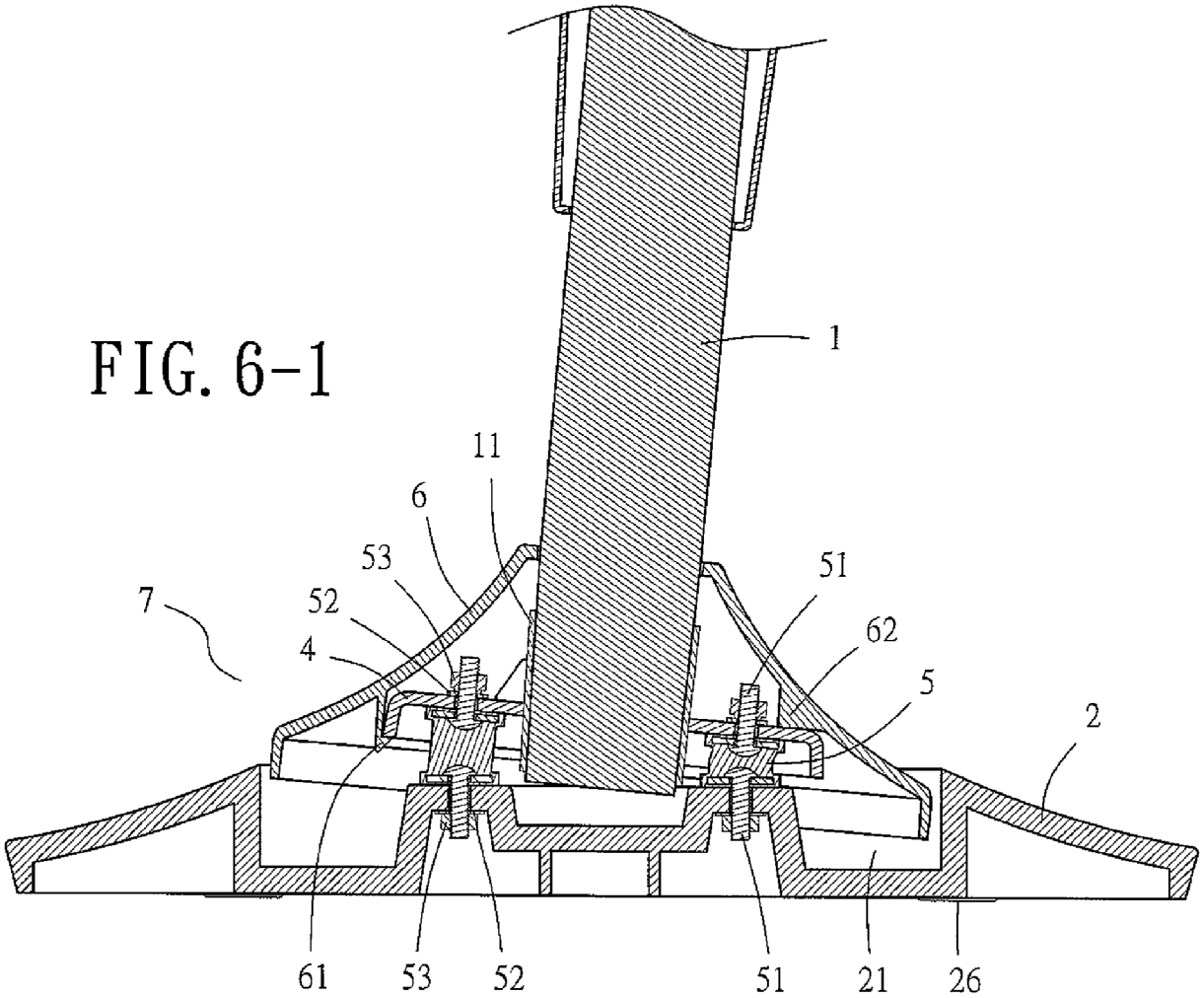
Figure 8:
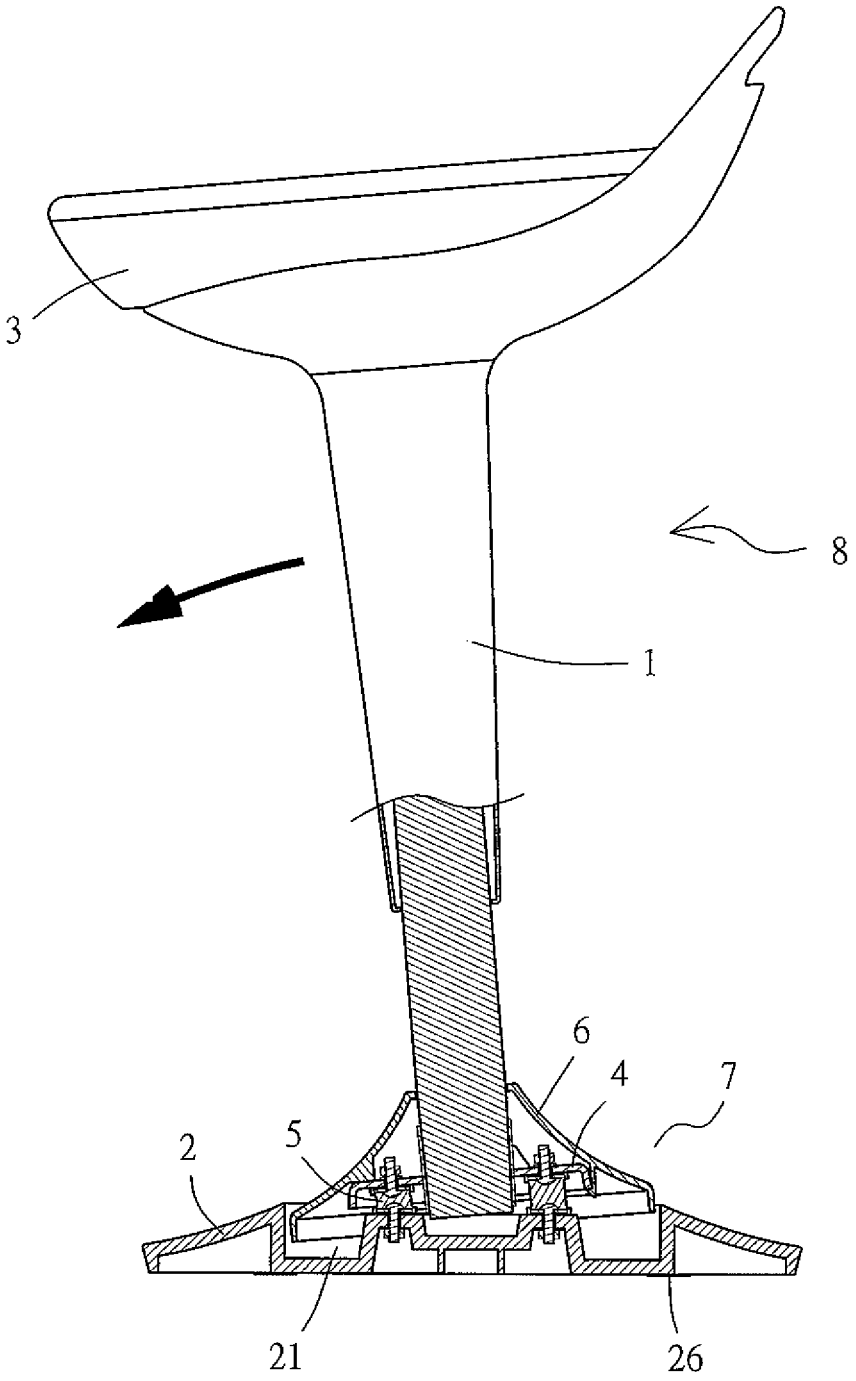
FIG. 8 is a cross-sectional view which shows the reclination adjustment unit coupled to the bottom of the office chair tilted forward and backward according to the present invention.
Figure 9:
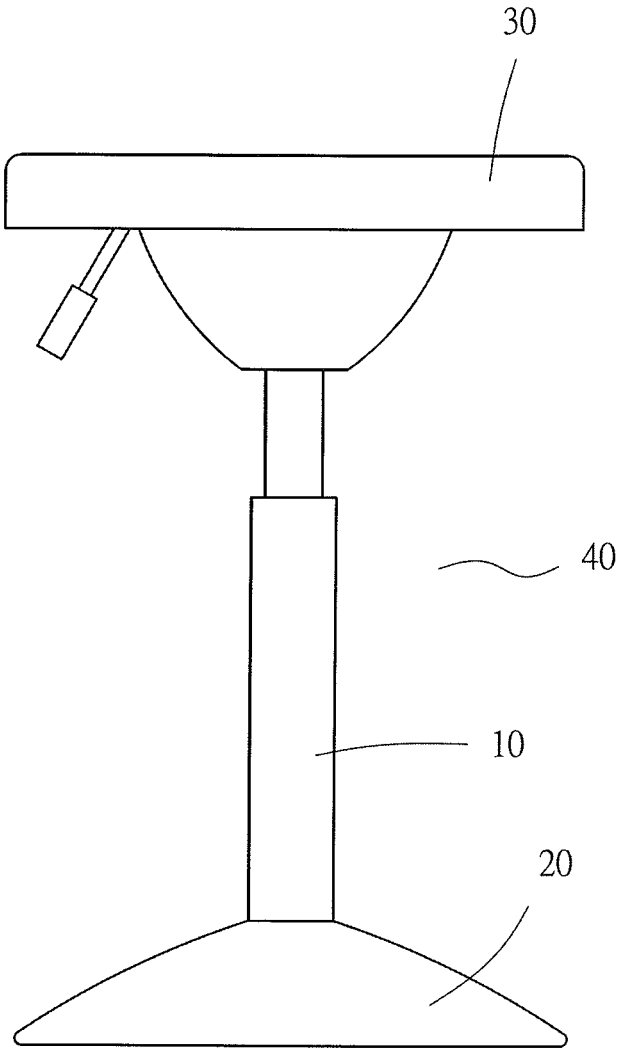
FIG. 9 (Prior Art)
FIG. 9 (prior art) is a front view of a conventional office chair.

Each carrying element 5 confined to between the bottom base 2 and the connecting element 4 is centrally constricted and has its upper and lower ends slightly protruded (as shown in FIG. 1, FIG. 5-1). Hence the reclination adjustment unit 7 not only maintains appropriate, resilient deformation but is also subjected to no excessive hindrance whenever the office chair 8 is tilted in any direction (as shown in FIG. 6, FIG. 8). The limiting segments 51, which extend outward from the carrying elements 5 and are confined to between the bottom base 2 and the connecting element 4, are less tough than the carrying elements 5 and the sleeve segment 11 and are formed integrally with and thus implanted in predetermined portions of the carrying elements 5, respectively. The reclination adjustment unit 7 further comprises recesses 23 (shown in FIG. 1) and ribs 24. The recesses 23 are concavely formed low at the bottom base 2. The ribs 24 are disposed at the bottom base 2 and separated by a predetermined distance. The ribs 24 form joint pipe segments 25. One end of a non-slip pad 26 is tightly admitted into a corresponding one of the joint pipe segments 25 (as shown in FIG. 2, FIG. 6-1).

Figure 7:
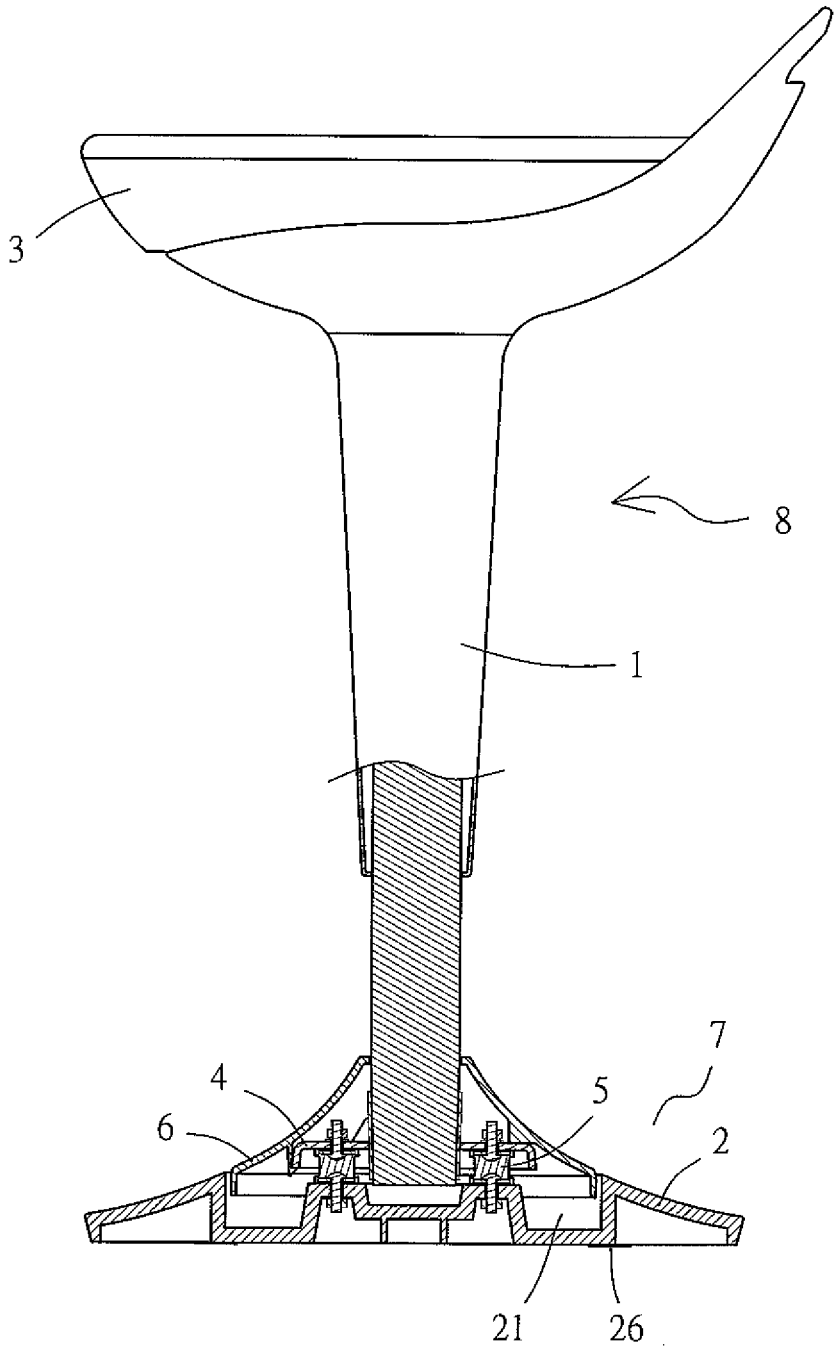
FIG. 7 is a cross-sectional view taken along line 70-70 of FIG. 4.

The reclination adjustment unit 7 (shown in FIG. 3) disposed at the bottom of the office chair 8 has advantages described below. The reclination adjustment unit 7 balances itself on the floor properly, resiliently and steadily (shown in FIG. 5, FIG. 7). As soon as the office chair 8 is tilted in a forward-backward direction (shown in FIG. 8) and/or a left-right direction (shown in FIG. 6), the carrying elements 5 sink obliquely into the receiving region 21 of the bottom base 2 (shown in FIG. 6-1) under a downward external force. Meanwhile the lower segment of the upright support portion 1 is limited by the middle of the connecting element 4 connected to one end of each carrying element 5. Hence, not only does the tilt of the support portion 1 fall within a range of safe inclinations, but the office chair 8 thus tilted also displays directional stability relative to the floor in a manner not to lose the directional stability even when the sitter tilts in any direction. Accordingly, the office chair 8 provides a comfortable seat for a user to sit on, regardless of whether the office chair 8 is upright or tilted in any direction.

What is claimed is:

1. A reclinable office chair, underpinned by a floor while being tilted in one of a forward-backward direction and a left-right direction, with an annular receiving region concavely defined in a space on an upward side of a base of the reclinable office chair and with a reclination adjustment unit disposed at a bottom of the reclinable office chair, wherein the reclination adjustment unit comprises a bottom base, a connecting element, carrying elements, and a concealing element, wherein limiting segments extend outward from the carrying elements and are confined to between the bottom base and the connecting element, wherein the connecting element and the bottom base are separated by a flexible distance, wherein hook portions and block portions extend downward from the concealing element to an extent to clamp the connecting element from above and below, wherein a through hole is centrally disposed at the concealing element and penetrable by an upright support portion of the reclinable office chair and a sleeve segment coupled to a lower segment of the upright support portion, wherein the upright support portion and the sleeve segment are inserted into and are connected to an opening centrally disposed at the connecting element, wherein the reclinable office chair tilted in one of the forward-backward direction and the left-right direction displays directional stability relative to the floor in a manner not to lose the directional stability even when a sitter tilts in any direction, thereby allowing the reclinable office chair to provide a seat for the sitter to sit on, regardless of whether the office chair is upright or tilted in any direction.

2. The reclinable office chair of claim 1, wherein the limiting segments, which extend outward from the carrying elements and are confined to between the bottom base and the connecting element, are each provided in a form of a threaded bolt segment for penetrating apertures of the bottom base below and apertures of the connecting element above and undergo directional engagement with washers and screwing components, and wherein each carrying element gives a resilient support effectuated and maintained between the connecting element and the bottom base.

3. The reclinable office chair of claim 1, wherein the hook portions and the block portions, which extend downward from the concealing element to clamp the connecting element from above and below, interlace with each other, thereby imposing a balanced directional limitation upon the connecting element from above and below.

4. The reclinable office chair of claim 1, wherein each carrying element is confined to between the bottom base and the connecting element, is centrally constricted, and has upper and lower ends protruded, and wherein the reclination adjustment unit not only maintains resilient deformation but is also subjected to no excessive hindrance whenever the reclinable office chair is tilted in any direction.

5. The reclinable office chair of claim 1, wherein the limiting segments, which extend outward from the carrying elements and are confined to between the bottom base and the connecting element, are formed integrally with and implanted in portions of the carrying elements, respectively.

6. The reclinable office chair of claim 1, wherein the reclination adjustment unit comprises recesses and ribs, with the recesses concavely formed low at the bottom base, and with the ribs disposed at the bottom base and separated by a distance to form joint pipe segments, allowing an end of a non-slip pad to be admitted into a corresponding one of the joint pipe segments.

* * * * *